United States Patent [19]

Schultz

[11] 3,981,536

[45] Sept. 21, 1976

[54] BACK SYSTEM FOR MODULAR SEATING

[76] Inventor: Wilmer R. Schultz, 1540 Chestnut St., Emmaus, Pa. 18049

[22] Filed: Dec. 30, 1974

[21] Appl. No.: 537,440

[52] U.S. Cl. ..... 297/444; 297/248

[51] Int. Cl.[2] ..... A47C 7/00

[58] Field of Search ..... 297/444, 248, 249, 460, 297/DIG. 2, 450, 451, 452, 160, 352, 154; 52/463, 468, 466; 24/263 A, 243 B; 108/105

[56] References Cited

UNITED STATES PATENTS

| | | | |
|---|---|---|---|
| 2,579,795 | 12/1951 | Chaillot | 297/249 |
| 3,079,198 | 2/1963 | Morgan et al. | 297/248 X |
| 3,091,881 | 6/1963 | Evans | 24/263 A X |
| 3,347,593 | 10/1967 | Walkinshaw | 297/248 |
| 3,390,765 | 7/1968 | Grant | 108/55 |
| 3,453,794 | 7/1969 | Blok | 52/466 |
| 3,497,262 | 2/1970 | Piretti et al. | 297/248 X |
| 3,619,004 | 11/1971 | McKernan et al. | 297/248 |
| 3,702,204 | 11/1972 | Tipton et al. | 297/248 |

*Primary Examiner*—James T. McCall
*Assistant Examiner*—Peter A. Aschenbrenner
*Attorney, Agent, or Firm*—Lowe, King, Price & Markva

[57] ABSTRACT

Backrest or back modules for stadium seating molded of plastic material are securely fastened along lateral edges to barlike support uprights by clips. Edges of adjacent backrest modules are inserted into upper and lower lips on the back supports; the opposed edges of the backrest modules are clamped by a single clip and abut a center stiffening rib on the supports. The clip has opposed horizontal reinforcing ribs which engage and clamp the brackrest module edges. The reinforcing ribs of the clip are chamfered so that as the clip is installed, the adjacent backrest module edges are drawn in or cammed snuggly against the center stiffening rib. Additional pressure applied by the fastener causes the reinforcing ribs of the clip to impress into the edges of the backrest modules causing surface cold-flow of the plastic material, thus eliminating both vertical and lateral movement.

7 Claims, 7 Drawing Figures

BACK SYSTEM FOR MODULAR SEATING

FIELD OF THE INVENTION

The present invention relates to modular seating and, more particularly to an improved assembly of backrest or back modules and supporting framework utilizing a single clip and fastener per seat assembly.

BACKGROUND OF THE INVENTION

Stadium or bleacher seating has in the past been made in the form of benches or chairs utilizing wooden planks or slats. Wooden seating suffers a disadvantage since as the world's supply of wood has become more in demand for other uses, such as furniture, paper, etc., it has become impractical to continue fabricating large numbers of stadium seats from wood. Furthermore, stadium seats are generally fabricated in such a manner as to be relatively inexpensive, and so, as anyone who has attended many events held in a stadium readily discovers, backrests are generally not available. Wooden backrests, in addition to being expensive to manufacture, are impossible to fabricate with a comfortable contour because of the inherent rigidity of the material. As a result, stadium seats are generally constructed in a continuous fashion with an uncomfortable flat seating surface and generally without backrests.

Wooden components have also always suffered the inherent disadvantage of being subject to deterioration from weathering and the attendant high cost of maintenance. Some attempt has been made to substitute aluminum to obviate this difficulty. However, aluminum transmits temperature differentials to the spectator making the seat uncomfortable. Aluminum seating also lacks comfort gained by compound curve contour available in plastic seating.

The modular seating concept for spectator seating wherein individually contoured seats of molded plastic material are assembled in juxtaposition on a metal substructure has now gained wide acceptance since it overcomes the shortcomings of both wood and aluminum. Modular seating units can be installed on steel or concrete substructures. The modular seats are also used on telescoping and portable units. Because they combine aluminum substructures and high density polyethylene seat modules, they are not only extremely durable, but also light in weight, further adding to their desirability.

The basic patent, illustrating this broad concept is U.S. Pat. No. 3,702,204, issued Nov. 7, 1972. I am a co-inventor of this basic patent.

Early in the marketing effort of the basic bleacher seat, it was recognized that there was a need for backrests for new installations. Further, updating current structures by adding back supports to modular seating makes an older facility new looking and can increase spectator attendance figures by offering the extra comfort.

In prior art chair frame structures of which I am aware, and in my first attempt at adding a back to the modular seat, the backrest members are joined in pairs with the edges of the members being simply secured by nuts and bolts. The presence of holes in the joined parts has been found to weaken the edges of the seat back and after continuous use, the fasteners passing through the seat backs tend to enlarge the hole causing the assembly to become loose. In addition, the location of the features, in close proximity to the backrest, made it difficult to reach with a screwdriver or other tool to tighten during initial installation.

In developing refinements and improvements to my initial attempt, it was thus important to me to provide a simplified structure or assembly that is permanent and secure, i.e., without parts that could become loose. The assembly had to be capable of accommodating the differential expansion due to thermal variations, as well as mechanical vibrations, and rough use normally found at sports events. The backs and the supports should be capable of withstanding relatively high loads which occur when sports fans improperly use the backrest as a footrest. My work in this direction has led to the present invention.

OBJECTS OF THE INVENTION

Accordingly, it is one object of the present invention to provide an improved modular back support assembly of simple, rugged and relatively inexpensive design for modular seating assemblies.

It is another object of the present invention to provide an improved modular back support assembly wherein the backrest is preferably of a contoured plastic material and which is durable, maintenance free, enconomical and versatile.

A further object is to provide an improved modular back support assembly wherein the assembly is securely fastened to back support members by a novel back mounting clip which is low in cost, sturdy and durable and cannot be easily vandalized.

A still further object is to provide an improved modular back support assembly wherein a novel die cast back mounting clip grips the edges of plastic back members and clamps them firmly to the supporting framework.

BRIEF DESCRIPTION OF THE INVENTION

The present invention provides an improved back assembly with a contoured backrest for modular seating. The assembly is particularly adapted for securing to an elongated rail substructure, as shown in the earlier basic U.S. Pat. No. 3,720,204, referenced above. The contoured backrests, like the seat modules, are fabricated of a unitary sheet of plastic material. The back supports are cast metal, such as aluminum, and are adapted for securing to the elongated framework, overlying the edges of the modules in a snug fashion. The substructure, as can be seen by close review of the prior patent, preferably comprises a pair of parallel runner rails, the top surfaces of which engage the planar supporting surface of the seat modules. Because of an overlying feature of the back supports, the seat modules are inherently clamped in position thereby obviating the need for the usual clamp downs where the seat backs of my present design are used.

The back support or back support with arms, are preferably one-piece castings made from high strength shock resistant aluminum alloy. The back support is preferably a T shape in cross section to provide the requisite ruggedness, while remaining lightweight and inexpensive.

Formed on the upper end of the back supports are an upper and a lower lip which assists in locating and holding the backrest modules. Adjacent backrest modules are inserted into the upper and lower lip on the supporting framework with the edges of the modules abutting the middle stiffening rib of the T shaped support.

The backrest modules are generally thermo formed, polyethylene, high density resin, which may be brightly colored to match the seat modules. The backrest modules are contoured to fit the curvature of a spectator's back for comfort. An outer peripheral lip portion provides a reinforcing top and bottom edge across the full width of the backrest module. The outer peripheral lip portion, including the side edges, are bent at substantially a right angle to the face of the backrest module.

The clearance of the module between the upper and lower lip, is such that with a slight flexure of the backrest module, it can slip under the upper lip after being initially positioned within the lower lip. A single clip according to the invention, holds the adjacent edges of the seat modules on each back support.

The one-piece clip is fabricated of a high strength, shock resistant, aluminum casting alloy. A fastener, with a tamper-proof socket securely fastens the clip to the back support.

The clip has a plurality of opposed horizontal reinforcing ribs which engage and clamp the vertically extending module edges to the stiffening rib of the supports. The clip is fastened to the middle stiffening rib to the back support with a single tamperproof fastener. The reinforcing ribs of the clip are chamfered so that as the clip is installed, the adjacent back rest module edges are drawn in tight against the middle stiffening rib. Pressure exerted by the clip causes the reinforcing ribs of the clip to impress into the edges of the back module, thus eliminating all possible movement.

Still other objects and advantages of the present invention will become readily apparent to those skilled in the art from the following detailed description, wherein I have shown and described only the preferred embodiment of the invention, simply by way of illustration of the best mode contemplated for carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive. One alternative embodiment of the clip is illustrated and described.

DETAILED DESCRIPTION OF THE INVENTION

Figure 1:
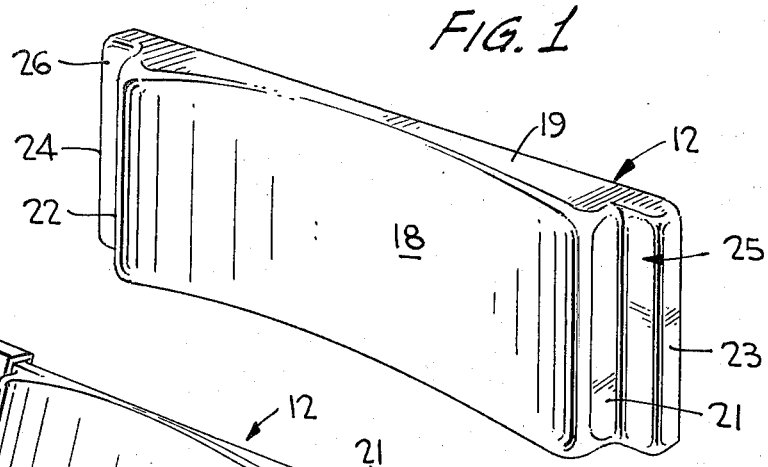
FIG. 1 is a perspective view of a preferred embodiment of a backrest module fabricated in accordance with the present invention.
Figure 2:
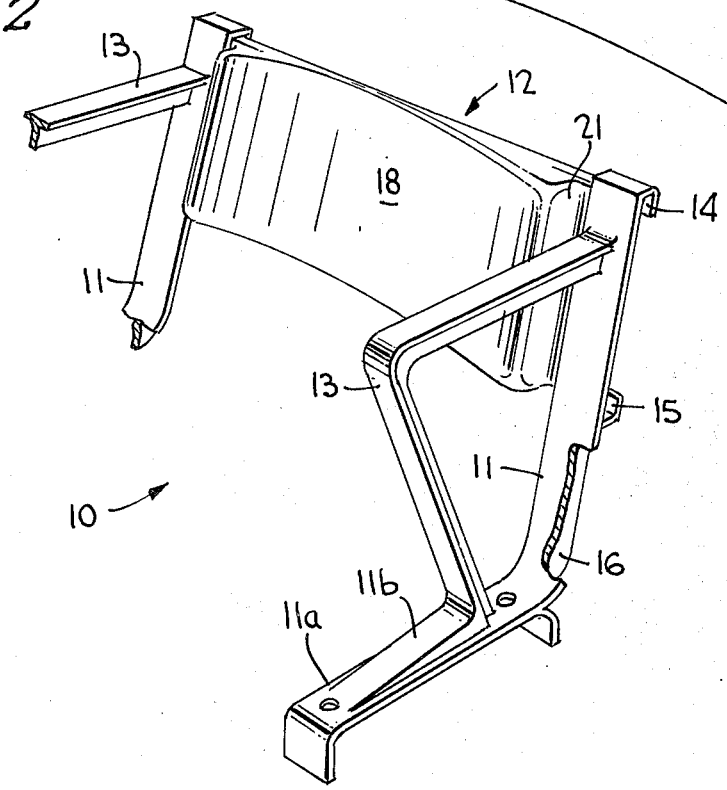
FIG. 2 is a perspective view showing the location of a single backrest held by spaced backrest supports.
Figure 3:
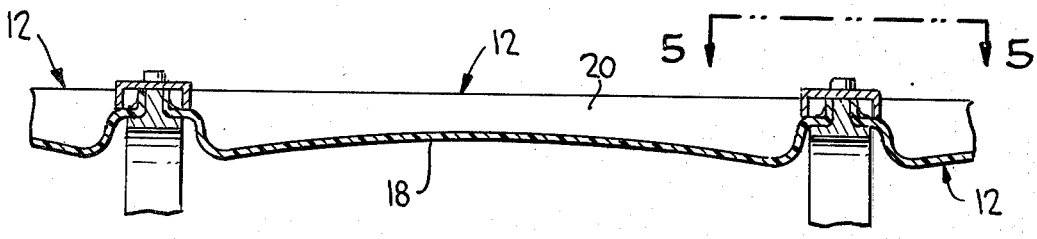
FIG. 3 is a cross-sectional view taken along lines 3—3 of FIG. 2 illustrating the interconnected backrest modules with the mounting clips and the fasteners in operative position.

The preferred embodiment of the backrest system for stadium seating or the like can best be seen in overview by reference to FIGS. 1–3 of the drawings. A backrest assembly, generally designated by the reference numeral 10 includes a bar-like back support 11 fabricated of suitable cast metal, such as aluminum, and a backrest module 12, formed of any suitable high strength engineering plastic material, such as high density polyethylene. As illustrated, the backrest module 12 is vacuum formed of sheet material having a contour suited for comfortably accommodating the user's back. Although the preferred embodiment is made by vacuum molding in a single step operation, it is to be understood that other methods of fabrication, including blow molding, can be used if desired. Each assembly 10 includes one module 12 and one support 11; it being understood that the support 11 of an adjacent assembly serves to support the other edge of the module.

The cross section of the upright back support 11 must be of a configuration to give the basic requisite strength. For purposes of illustration of the preferred embodiment, the support is a T section.

The back system or a plurality of assemblies 10 may be suitably mounted to modular stadium seats (not shown) by the integral clamp-down base 11*a*. This curved base engages and holds the adjacent edges of the seat modules in place of the usual clampdowns illustrated in my earlier patent.

Each back support 11, may be formed with or without arm rest or arm 13. The arm 13 does provide additional strength for the upright section of the back support 11 and, of course, contributes comfort for the user. Integral reinforcement ridge 11*b* is preferably included along the base 11*a* in either the embodiment with arms, or the one without arms (not shown).

Formed at the top of the upright section of the back support 11 are upper retaining lip 14 and lower retaining lip 15. The lateral edges of the back seat modules 12 are received between these lips to position said modules 12 in a normal horizontal position. Upper and lower lips 14, 15 in combination with the middle stiffening rib 16 of T section back support 11 in effect form a receptacle to conveniently hold and grip the edges. Together, the front of the support 11, the lips 14, 15 and the rib 16 hold the modules captive and positively prevent the module from being removed toward the front, to either side or in the up or down direction. A tapped hole 17 is provied in the rib 16 to accept a suitable bolt fastener 17*a* for a purpose that will be presently apparent.

Front surface 18 of the module 12 has a contour suited for comfortably accommodating the user's back. Increased rigidity of the backrest module 12 results from top and bottom flanges 19, 20 of the peripheral lip portion of the module 12. Raised sides 21, extending between top and bottom flanges 19, 20, form a ridge supporting the ends of the front surface 18 in a curved manner. Side flanges 23, 24 are also formed by the peripheral lip portion. Flat connecting surfaces 25, 26, extend at right angles to the side flanges or edges 21, 22, and between top and bottom flanges 19, 20.

Figure 4:
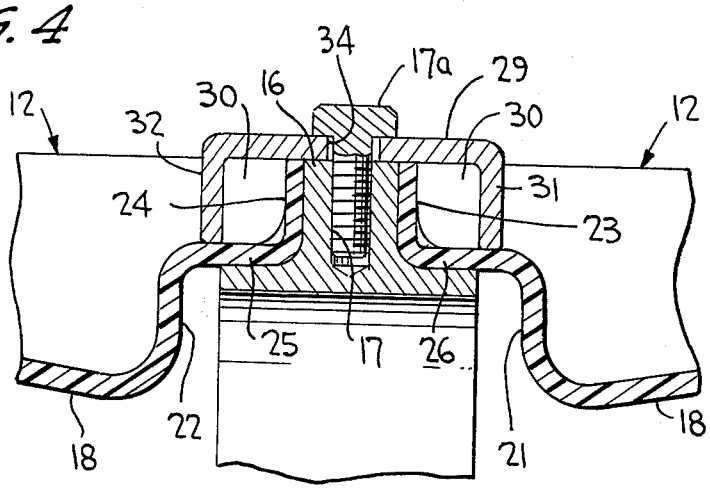
FIG. 4 is an enlarged cross-sectional view like FIG. 3 showing the details of the clip and fastener of the backrest system in accordance with the present invention.
Figure 6:
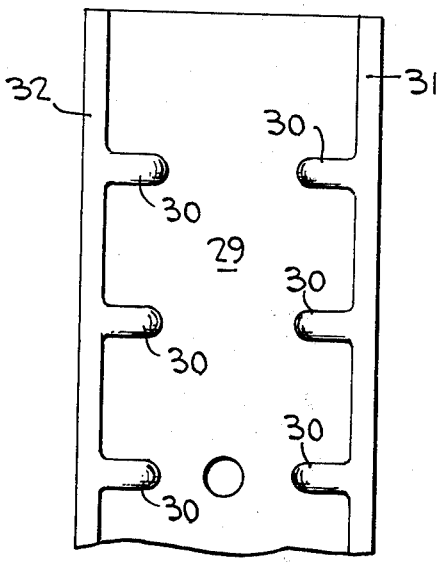
FIG. 6 is an enlarged view of the interior details of construction of the preferred cast embodiment of the clip made in accordance with the present invention.
Figure 5:
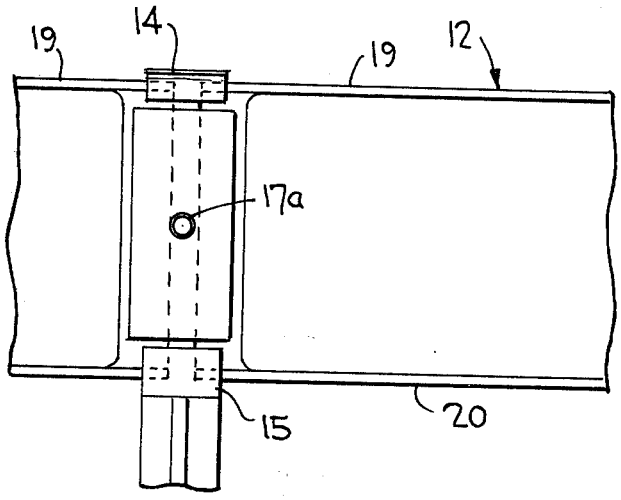
FIG. 5 is a back view of the assembly taken along lines 5—5 of FIG. 3.

According to an important feature of the present invention, a clip 29, fabricated of suitable metal such as aluminum, is provided to fasten the adjacent edges 23, 24 of the modules to the support 11 (see FIG. 4). The clip 29 includes an open C-shaped body with a plurality of ribs 30 joining and reinforcing 90° angles formed by side legs 31, 32. The reinforcing ribs 30 are chamfered at their inner edges. This feature provides ease of assembly of the clip support. The rounded configuration engages the module edges or flanges 23, 24 and pulls or cams them in snug against the rib 16 as the clip moves into final position. When this camming pressure is applied, it is also clear that the reinforcing ribs 30 provide a high unit pressure casing a slight cold-flow of plastic material at spaced locations along the inside faces of the flanges. This action aids in forming a permanent locked joint. Also provided in clip 29 is an aperture 34, centrally located on clip face, so as to align with the hole 17 and for passage of the fastener 17*a*.

Figure 7:
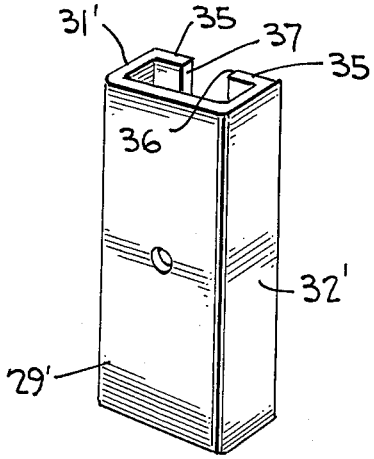
FIG. 7 is a perspective view of an alternative extruded embodiment of a clip which may be used.

In the alternative embodiment of FIG. 7, clip 29′ is shown as a substantially C-shaped extrusion. This clip comprises side legs 31′, 32′ and reverse feet 35 attached to the side legs. The feet 35 are utilized in lieu of the reinforcing ribs 30 of the preferred clip 29; that is, for providing the holding pressure on the module side edges 23, 24 upon assembly. In this embodiment, inner edge faces 36, 37 force the side edges 23, 24 toward the rib 16 of back support 11 and thereby grippingly lock the modules in position. The edge faces 36, 37 extend vertically and extend along the full height of the clip 29′.

To install the back system of the invention, the back supports 11 are first loosely fastened to the elongated seat substructure. This is usually accomplished by fasteners (not shown) passing through the apertures in the base portions 11*a* of the supports 11 (see FIG. 2). Backrest modules 12 are then flexed slightly and inserted into the receptacle-like area bounded by the lips 14, 15 and rib 16. The loose mounting of the supports 11 at this point assists in this. Once in place, the backrest modules 12 are held in position during installation. The one-piece, multi-ribbed clip 29 is now placed in position from the rear to engage and clamp the backrest module lips 23, 24 and draw them together toward the center reinforcing rib 16 of the back support 11. The fastener 17*a* is then inserted through the hole 34 of clip 29 and tightened down into the tapped hole 17.

These simple steps of installation including free access to fastener 17*a* are conveniently handled from the rear of back support 11. The fastener head is preferably formed with a tamper proof special indentation which requires a special tool for removal. As the assembler draws the fastener 17*a* down tight, the inner ribs 30 bite into the edge 23, 24 securely locking the modules in the supports. Finally, the fasteners for the bases 11*a* are reengaged and tightened completing the installation.

It will thus be seen that the objects set forth above, as well as others made apparent from the preceding description, are effeciently attained. Certain changes may be made in the specific designs employed in the preferred embodiment and the alternative embodiment without departing from the broad scope of the invention. Thus, it is intended that all matter contained in the above description, or shown in the accompanying drawings, shall be interpreted insofar as the broad concepts are concerned, as illustrative, and not in a limiting sense.

What is claimed is:

1. A backrest assembly for modular stadium seating or the like comprising:

upright support means attached to said seating;

a backrest module carried by said support means above said seating in position to engage and rest the back of the user;

said module having a lateral flange formed by a first portion extending substantially parallel to said module and a second portion turned at substantially a right angle to said module extending substantially parallel and in juxtaposition to said upright support;

clip means for gripping the lateral edge of said backrest means;

said clip means including a body, holding means on said body engaging said flange in opposed relationship to said upright support means and causing both said portions of said flange to engage snugly in substantially full face-to-face contact against said upright support; and fastener means for attaching said clip to said support means for holding said backrest means in position.

2. The assembly of claim 1 wherein is further provided an upper and lower lip on said support means for receiving said edge of said backrest means.

3. The assembly of claim 1 wherein said support means is a bar, a center rib formed on said bar for reinforcement, said flange extending along said rib.

4. The assembly of claim 1 wherein said clip means comprises an open body having a cross member and side legs formed at substantially right angles thereto, and said holding means comprises reinforcing ribs formed at the angles forming the legs of the body and substantially perpendicular to said legs, said ribs providing areas of high unit holding pressure against said flange to securely lock said module.

5. The assembly of claim 1 wherein said ribs of said clip means are chamfered along their inner edges to assist in engaging the flange of said module edge.

6. The assembly of claim 5 wherein said clip means is fabricated from cast aluminum alloy.

7. The assembly of claim 1 wherein said clip means is fabricated from substantially rigid extruded aluminum alloy and comprising an open body having a cross member and side legs formed at substantially right angles thereto, said holding means being reversely directed feet on the end of the side legs of the body having an inner edge to engage the flange of said module edge.

* * * * *